United States Patent [19]

Fink

[11] Patent Number: 4,813,293

[45] Date of Patent: Mar. 21, 1989

[54] ROTARY DRIVE, IN PARTICULAR FOR VEHICLE DOORS

[75] Inventor: Martin Fink, Waidhofen a.d. Ybbs, Austria

[73] Assignee: IFE Industrie-Einrichtungen Fertigungs-Aktiengesellschaft

[21] Appl. No.: 4,440

[22] PCT Filed: Apr. 16, 1986

[86] PCT No.: PCT/AT86/00034

§ 371 Date: Dec. 10, 1986

§ 102(e) Date: Dec. 10, 1986

[87] PCT Pub. No.: WO86/06131

PCT Pub. Date: Oct. 23, 1986

[30] Foreign Application Priority Data

Apr. 16, 1985 [AT] Austria ..... 1139/85

[51] Int. Cl.[4] ..... E05F 15/04

[52] U.S. Cl. ..... 74/99 A; 277/95

[58] Field of Search ..... 74/18, 18.1, 99 R, 99 A; 92/31; 277/95

[56] References Cited

U.S. PATENT DOCUMENTS

| | | | |
|---|---|---|---|
| 2,331,997 | 10/1943 | Mensenkamp | 74/99 R |
| 2,791,909 | 5/1957 | Rick | 74/99 R |
| 2,948,128 | 8/1960 | Smith | 74/18 |
| 3,173,244 | 3/1965 | Schutmaat | 74/99 R |
| 3,677,472 | 7/1972 | Hart et al. | 277/95 |
| 3,776,106 | 12/1973 | Pish | 74/99 R |
| 4,290,344 | 9/1981 | Adams | 92/31 |
| 4,678,010 | 7/1987 | Purvis et al. | 138/31 |

FOREIGN PATENT DOCUMENTS

| | | |
|---|---|---|
| 598627 | 10/1925 | France . |
| 2328093 | 5/1977 | France . |
| 2411293 | 7/1979 | France . |
| 2073815 | 10/1981 | United Kingdom . |

*Primary Examiner*—Lawrence Staab

*Attorney, Agent, or Firm*—Toren, McGeady & Associates

[57] ABSTRACT

Rotary drive, particularly for vehicle doors, in which the piston motion of a piston-power cylinder-unit 5 is converted into a rotary motion by means of roller pairs 14 which engage into oblique slots 10, 11. The oblique slots are provided in cylinders 4, 6 arranged coaxially inside each other and one of the cylinders is connected to the power output shaft 7. The slots exhibit an axial direction at their ends. Herein the cover 2 of a pot-shaped housing 1, through which cover the power output shaft 7 passes, exhibits a collar 15 projecting outwards and embracing the power output shaft. The power output shaft 7 is provided with a cup-type seal 17 seated firmly upon it, whose surface contour 18 overlaps outwardly the collar 15 and which with its edge 19 rests tightly at the cover 2. The cover is provided with an axially oriented groove 20 on its side facing away from the collar, into which groove the edge of the pot-shaped housing 1 is tightly fitted.

2 Claims, 2 Drawing Sheets

Figure 1:
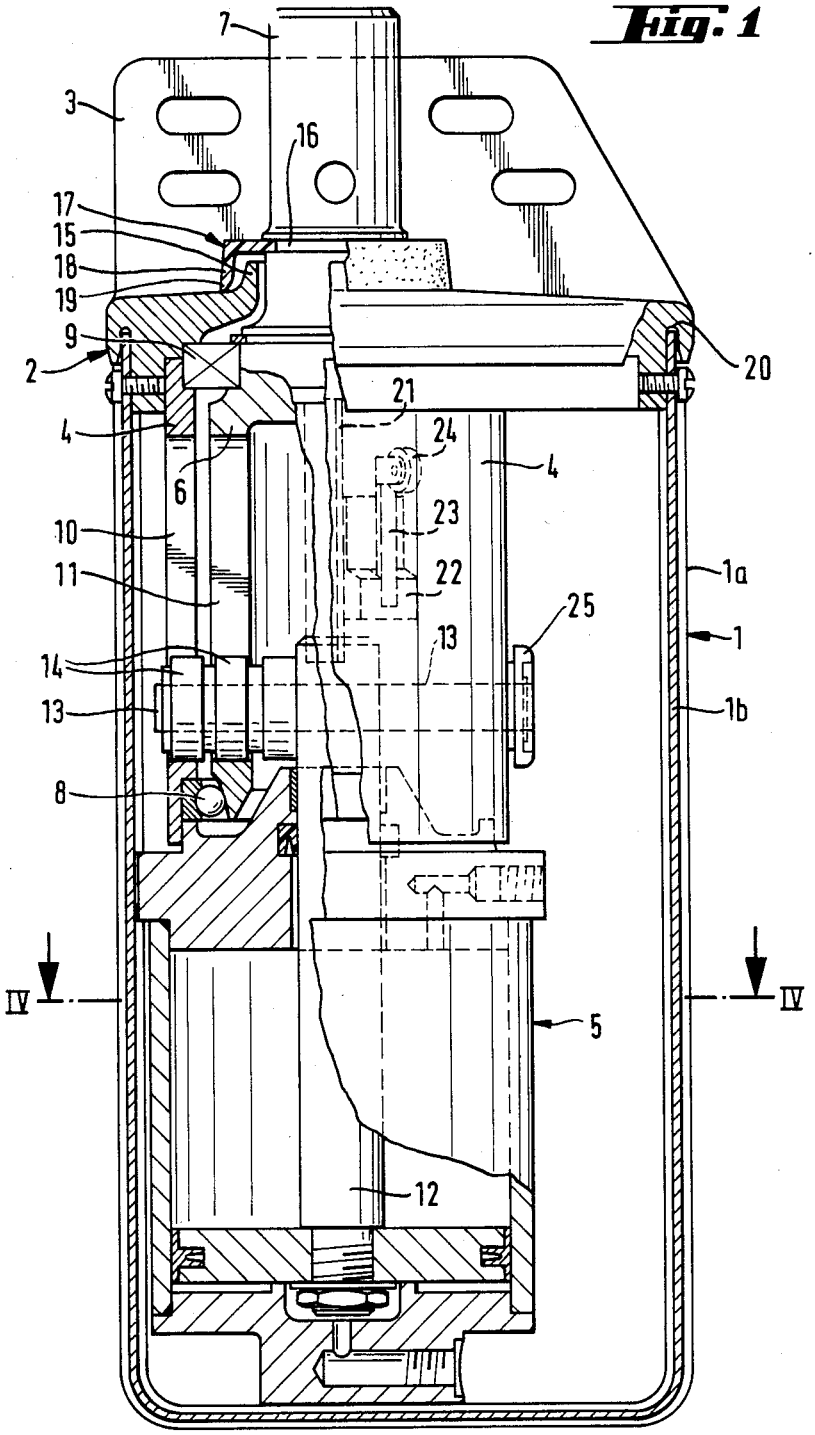

7
3
16
17
15
18
19
9
2
20
21
24
4
4
6
23
10
22
1a
11
25
1
13
14
13
1b
8
IV
IV
5
12

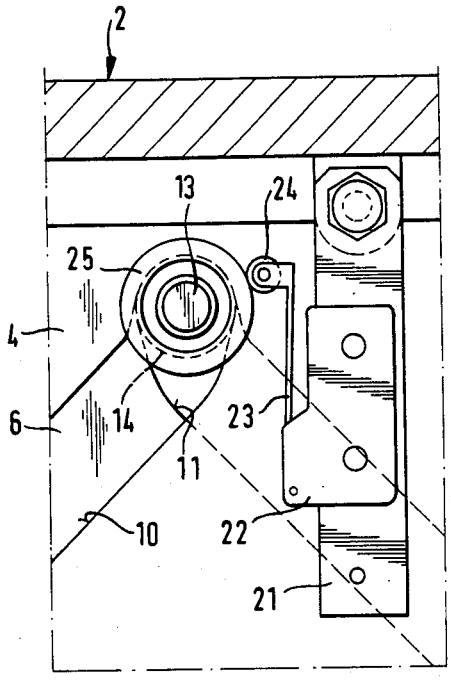
Fig. 2
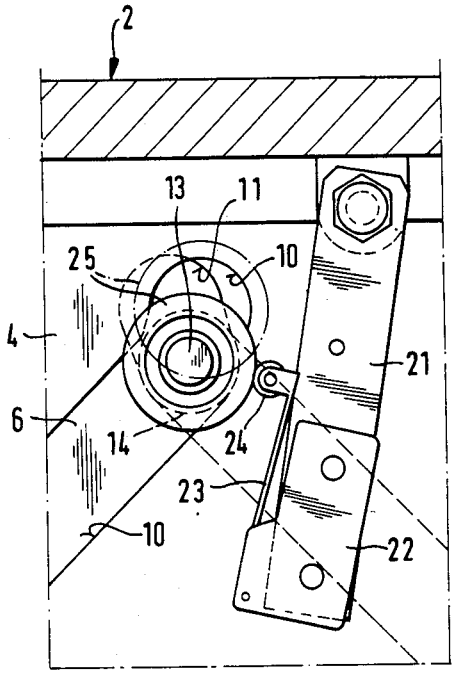
Fig. 3
Fig. 4
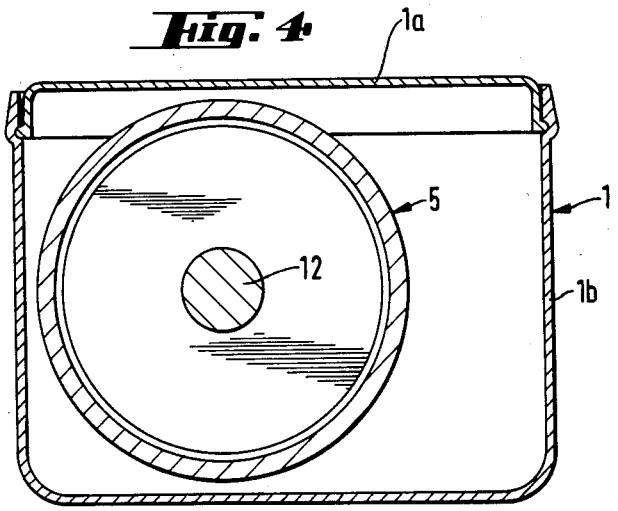

ROTARY DRIVE, IN PARTICULAR FOR VEHICLE DOORS

The invention is directed to a rotary drive, in particular, for vehicle doors, in which the piston motion of a hydraulic or pneumatic piston-power cylinder-unit is converted into rotary motion of one of the cylinders connected with a power output shaft by means of roller pairs, which engage into inclined slots provided in cylinders arranged coaxially inside each other, wherein the slots transit into an axial direction at their end.

The known rotary drives of this type exhibit the disadvantage that they often do not satisfy the exacting conditions to which they are exposed. Above all the leakage in the housing repeatedly occurs, principally in the region of the passage of the power output shaft, so that functional deficiencies arise.

The aim of the invention is the creation of a rotary drive with a leak-proof housing, which, however, does not complicate the accessibility to the components of the drive.

This aim is attained in the invention in that the cover of the pot-shaped housing, through which the power output shaft passes, exhibits a collar embracing the power output shaft, which collar projects outwards and in that the power output shaft is equipped with a cup-shaped seal firmly seated in an annular groove, whose surface contour overlaps the collar from the outside and rests tightly at the cover with its edge, wherein said cover is provided with an axially oriented annular groove at its side facing away from the collar, into which the edge of the pot-shaped housing is tightly fitted.

The invention is further directed to the structural embodiment of the rotary drive.

The subject of the invention is depicted in the drawing by way of an embodiment form as an example.

FIG. 1 shows an axial section through the rotary drive,

FIGS. 2 and 3 different arrangements of a switch and

FIG. 4 a section along the line IV—IV in FIG. 1.

A pot-shaped housing 1, FIG. 4, consisting of the parts 1*a* and 1*b* is sealed with the cover 2, which exhibits an attachment flange 3 for the rotary drive. An outer cylinder 4 is provided inside of the housing, which cylinder is rigidly connected with the cover 2 and with a piston-cylinder unit designated with 5 in its entirety. This unit can be laid out for hydraulic or pneumatic media. A second cylinder 6 is provided coaxially inside of the cylinder 4, which second cylinder transits into a power output shaft 7 passing through the cover 2. The inner cylinder is rotatably supported in the ball bearings 8, 9.

Both cylinders exhibit slots 10 and 11, which extend obliquely to the axis of the drive and transit at their ends into an axial direction, as is shown in the FIGS. 2 and 3.

A radially oriented axis 13 sits on the piston rod 12 of the piston cylinder unit 5 on which axis roller pairs 14 are rotatably supported on both sides. The rollers run in the slots 10 and 11. In case of an axial movement of the piston rod 12 the inner cylinder 6 and with it the power output shaft 7 is rotated relatively to the outer cylinder 4 and the door movement is effected in this manner. The construction of the rotary drive is known and therefore not a subject of the invention.

For a tight termination of this drive a cover 2 is provided with a collar 15 embracing the power output shaft 7, whose outer front face extends obliquely towards the cover edge, so that the liquid can be diverted towards the circumference. The power output shaft 7 is provided with an annular groove 16, into which a cup-shaped seal 17 is tightly fitted. The outer contour 18 of this seal overlaps the collar 15 and the seal edge 19 rests tightly at the front face of the cover 2. Said cover exhibits at the opposite side an axially oriented groove 20, into which the edge of the housing 1 is tightly fitted.

In this manner a completely satisfactory sealing is assured also in the course of exacting operation as tests have shown. In order to facilitate the accessibility of the individual components, the housing 1 is preferably divided along a plane which extends parallel to the piston rod 12, as shown in FIG. 4.

It is often desired that the condition of the rotary drive be indicated, principally the locking condition must be indicated. For this purpose it has been been the practice to provide an appropriate switch, which is acted upon in circumferential direction by the position of the axis 13 of the roller pairs 14. Since, however, the orientation of the slots 10 and 11 approaches the axial direction in their end area, the scanning accuracy is low. In order to remove this discrepancy it is provided in the invention to scan the axial position of the axis 13. Since the motion of this axis 13 in the end section of the slots 10 and 11 in axial direction greatly exceeds the motion in circumferential direction, the accuracy of the scanning can thus be considerably improved.

As is shown in FIG. 2 the switch 22 is provided at an arm 21, whose switch arm 23 carries a scanning roller 24, which cooperates with a disk 25 seated upon the axis 13. In the position of the switch 22 depicted in the FIG. 1 the final position of the rotary drive is being scanned and thus the signal "door locked" is given.

According to FIG. 3 the switch 22 is arranged to be offset at the arm 21 and this arm is attached in an oblique manner, so that the scanning roller 24 monitors the disk 25 in a movement segment of the axis 13, which is constituted by the transition of the slots 10, 11 into the axial direction. In this arrangement the switch 22 signals "reversing switched off".

Thus a switch is provided according to the invention, whose scanner projects into a segment of the movement path of a portion of the axis carrying the roller pairs, which portion protrudes outwardly from the outer cylinder provided with the oblique slots, wherein said segment is at the termination of the movement path or at the transition into the axial segment of the oblique slots.

The invention is not limited to the depicted embodiment form.

I claim:

1. Rotary drive, in particular for vehicle doors, in which the piston motion of a hydraulic or pneumatic piston-cylinder-unit is converted into rotary motion of one of these cylinders connected with a power output shaft by means of roller pairs, which engage into inclined slots provided in cylinders arranged coaxially inside each other, wherein the slots transit into an axial direction at their ends, characterized in that the cover (2) of a pot-shaped housing (1) through which the power output shaft (7) passes exhibits an outwardly projecting collar (15) seated firmly upon it, whose surface contour (18) outwardly overlaps the collar and with its edge (19) rests tightly at said cover, wherein said cover is provided with an axially oriented groove (20) on its side facing away from the collar, into which groove the edge of the pot-shaped housing (1) is inserted in a sealing manner, and wherein the pot-shaped housing (1) is divided along a plane extending parallel to the axis of the piston rod (12).

2. Rotary drive according to claim 1, characterized in that the free front face of the cover (2) extends obliquely from the collar (15) towards the circumference.

* * * * *